US008944507B2

(12) United States Patent
Goetz

(10) Patent No.: US 8,944,507 B2
(45) Date of Patent: Feb. 3, 2015

(54) ERGONOMIC ADJUSTABLE CHAIR MECHANISMS

(75) Inventor: Mark W. Goetz, Brooklyn, NY (US)

(73) Assignee: Herman Miller, Inc., Zeeland, MI (US)

( * ) Notice: Subject to any disclaimer, the term of this patent is extended or adjusted under 35 U.S.C. 154(b) by 864 days.

(21) Appl. No.: 12/903,191

(22) Filed: Oct. 12, 2010

(65) Prior Publication Data

US 2011/0101748 A1 May 5, 2011

Related U.S. Application Data

(60) Provisional application No. 61/251,050, filed on Oct. 13, 2009.

(51) Int. Cl.

| | |
|---|---|
| ***A47C 3/00*** | (2006.01) |
| ***A47C 1/00*** | (2006.01) |
| ***A47C 7/02*** | (2006.01) |
| ***A47C 7/46*** | (2006.01) |
| ***A47C 9/00*** | (2006.01) |
| ***A47C 1/034*** | (2006.01) |
| ***A47C 3/36*** | (2006.01) |
| ***A61G 5/14*** | (2006.01) |

(52) U.S. Cl.

CPC ..... *A47C 7/022* (2013.01); *A47C 7/462* (2013.01); *A47C 9/002* (2013.01); *A47C 1/0342* (2013.01); *A47C 3/36* (2013.01); *A47C 7/024* (2013.01); *A47C 9/005* (2013.01); *A61G 5/14* (2013.01)

USPC ..... 297/344.15; 297/321

(58) Field of Classification Search

USPC ..... 297/344.15, DIG. 10, 284.11, 321

See application file for complete search history.

(56) References Cited

U.S. PATENT DOCUMENTS

| | | | | | |
|---|---|---|---|---|---|
| 1,434,777 | A | * | 11/1922 | Handler | 297/19 |
| 1,619,686 | A | * | 3/1927 | Witkowski | 297/284.11 |
| 3,224,808 | A | | 12/1965 | Spielman | |
| 3,356,413 | A | | 12/1967 | Radke et al. | |
| 3,493,211 | A | * | 2/1970 | Barecki et al. | 248/567 |
| 3,495,873 | A | * | 2/1970 | Hamilton et al. | 297/344.15 |
| 3,550,953 | A | * | 12/1970 | Neale | 297/312 |
| 3,788,697 | A | * | 1/1974 | Barton et al. | 297/307 |
| 3,964,725 | A | * | 6/1976 | Matsui et al. | 248/421 |
| 4,181,353 | A | | 1/1980 | Grass et al. | |

(Continued)

FOREIGN PATENT DOCUMENTS

| | | |
|---|---|---|
| EP | 0 672 370 B1 | 2/1999 |
| GB | 2 439 918 A | 1/2008 |

(Continued)

OTHER PUBLICATIONS

International Preliminary Report on Patentability for International Application No. PCT/US2011/055607, dated Apr. 16, 2013, 6 pages.

(Continued)

*Primary Examiner* — David R Dunn
*Assistant Examiner* — Tania Abraham
(74) *Attorney, Agent, or Firm* — Brinks Gilson & Lione

(57) ABSTRACT

Seating mechanisms enable the user to vary the seating angle of a chair or stool by enabling at least the portion of the chair that supports the thighs to be tilted forwardly to controllably increase the seating angle while maintaining the spine and pelvic region in vertical alignment. The extent of forward tilt is controlled by pressure applied by the user's thighs that also serves to counterbalance the weight of the user's torso.

13 Claims, 15 Drawing Sheets

(56) References Cited

U.S. PATENT DOCUMENTS

| | | | | | |
|---|---|---|---|---|---|
| 4,249,774 | A | * | 2/1981 | Andreasson | 297/311 |
| 4,502,729 | A | | 3/1985 | Locher | |
| 4,521,053 | A | * | 6/1985 | de Boer | 297/312 |
| 4,529,247 | A | | 7/1985 | Stumpf et al. | |
| 4,776,633 | A | | 10/1988 | Knoblock et al. | |
| 4,804,227 | A | | 2/1989 | Hansen | |
| 4,889,385 | A | | 12/1989 | Chadwick et al. | |
| 5,024,484 | A | | 6/1991 | Buchacz | |
| 5,035,466 | A | | 7/1991 | Mathews et al. | |
| 5,100,201 | A | | 3/1992 | Becker, III et al. | |
| 5,195,801 | A | | 3/1993 | Franck et al. | |
| 5,244,252 | A | | 9/1993 | Serber | |
| 5,320,410 | A | | 6/1994 | Faiks et al. | |
| 5,401,077 | A | | 3/1995 | Hosoe | |
| 5,435,623 | A | * | 7/1995 | Kapec et al. | 297/339 |
| 5,486,035 | A | | 1/1996 | Koepke et al. | |
| 5,536,067 | A | | 7/1996 | Pinto | |
| 5,558,399 | A | | 9/1996 | Serber | |
| 5,597,203 | A | * | 1/1997 | Hubbard | 297/284.3 |
| 5,651,585 | A | * | 7/1997 | Van Duser | 297/344.16 |
| 5,711,575 | A | | 1/1998 | Hand et al. | |
| 5,735,574 | A | | 4/1998 | Serber | |
| 5,772,282 | A | | 6/1998 | Stumpf et al. | |
| 5,810,440 | A | | 9/1998 | Unwalla | |
| 5,873,627 | A | | 2/1999 | Kosmatka et al. | |
| 5,909,923 | A | | 6/1999 | DeKraker | |
| 5,984,411 | A | * | 11/1999 | Galumbeck | 297/344.15 |
| 6,086,153 | A | | 7/2000 | Heidmann et al. | |
| 6,109,694 | A | | 8/2000 | Kurtz | |
| 6,318,800 | B1 | | 11/2001 | DeKraker | |
| 6,386,634 | B1 | | 5/2002 | Stumpf et al. | |
| 6,431,649 | B1 | | 8/2002 | Hensel | |
| 6,533,352 | B1 | | 3/2003 | Glass et al. | |
| 6,609,755 | B2 | | 8/2003 | Koepke et al. | |
| 6,616,228 | B2 | | 9/2003 | Heidmann | |
| 6,669,292 | B2 | | 12/2003 | Koepke et al. | |
| 6,695,404 | B2 | | 2/2004 | Bruske | |
| 6,702,390 | B2 | | 3/2004 | Stumpf et al. | |
| 6,729,691 | B2 | | 5/2004 | Koepke et al. | |
| 6,733,080 | B2 | | 5/2004 | Stumpf et al. | |
| 6,749,261 | B2 | | 6/2004 | Peterson et al. | |
| 6,752,459 | B2 | | 6/2004 | Deisig | |
| 6,805,322 | B2 | | 10/2004 | Schmidt | |
| 6,805,405 | B2 | | 10/2004 | Koo | |
| 6,811,218 | B2 | | 11/2004 | Deimen et al. | |
| 6,811,225 | B1 | | 11/2004 | Konya et al. | |
| 6,869,142 | B2 | | 3/2005 | Heidmann et al. | |
| 6,905,171 | B2 | | 6/2005 | Knoblock et al. | |
| 6,945,605 | B2 | | 9/2005 | Kinoshita et al. | |
| 6,966,604 | B2 | | 11/2005 | Stumpf et al. | |
| 6,991,291 | B2 | | 1/2006 | Knoblock et al. | |
| 7,029,071 | B2 | | 4/2006 | Watson et al. | |
| 7,055,904 | B2 | * | 6/2006 | Skelly et al. | 297/284.9 |
| 7,114,777 | B2 | | 10/2006 | Knoblock et al. | |
| 7,118,176 | B2 | | 10/2006 | Erker | |
| 7,234,775 | B2 | | 6/2007 | Serber | |
| 7,255,399 | B2 | | 8/2007 | White et al. | |
| 7,350,863 | B2 | * | 4/2008 | Engels et al. | 297/284.11 |
| 7,441,839 | B2 | | 10/2008 | Pennington et al. | |
| 7,478,879 | B2 | | 1/2009 | Robinson | |
| 7,540,565 | B2 | * | 6/2009 | Lipford | 297/325 |
| 7,594,700 | B2 | | 9/2009 | Stumpf et al. | |
| 7,686,399 | B2 | | 3/2010 | Heidmann et al. | |
| 7,695,067 | B2 | | 4/2010 | Goetz et al. | |
| 7,712,834 | B2 | | 5/2010 | Knoblock et al. | |
| 7,717,515 | B2 | | 5/2010 | Saez et al. | |
| 7,794,017 | B2 | | 9/2010 | Kan et al. | |
| 7,798,573 | B2 | | 9/2010 | Pennington et al. | |
| 7,837,265 | B2 | | 11/2010 | Machael et al. | |
| 7,841,666 | B2 | | 11/2010 | Schmitz et al. | |
| 7,922,248 | B2 | | 4/2011 | Aldrich et al. | |
| 2003/0151288 | A1 | | 8/2003 | Deisig | |
| 2003/0230918 | A1 | | 12/2003 | Serber | |
| 2004/0245840 | A1 | | 12/2004 | Tubergen et al. | |
| 2005/0029849 | A1 | | 2/2005 | Goetz et al. | |
| 2005/0275264 | A1 | | 12/2005 | Norman et al. | |
| 2006/0103221 | A1 | | 5/2006 | Kleist | |
| 2006/0175884 | A1 | | 8/2006 | Jenkins | |
| 2007/0080570 | A1 | | 4/2007 | Kohl et al. | |
| 2007/0228794 | A1 | | 10/2007 | Penley | |
| 2008/0179930 | A1 | | 7/2008 | Harley | |
| 2009/0195040 | A1 | | 8/2009 | Birkbeck | |
| 2009/0242700 | A1 | | 10/2009 | Raymond | |
| 2010/0066146 | A1 | | 3/2010 | Weber et al. | |
| 2010/0187881 | A1 | | 7/2010 | Fujita et al. | |
| 2010/0207354 | A1 | | 8/2010 | Hunziker | |
| 2011/0031793 | A1 | | 2/2011 | Machael et al. | |
| 2011/0101748 | A1 | | 5/2011 | Goetz | |

FOREIGN PATENT DOCUMENTS

| | | | | | |
|---|---|---|---|---|---|
| JP | 2-46811 | | | 8/1989 | |
| JP | 5-207920 | A | | 8/1993 | |
| JP | 2002-119367 | | | 4/2002 | |
| JP | 2007-50121 | A | | 3/2007 | |
| WO | WO 9317604 | A1 | * | 9/1993 | A47C 7/50 |
| WO | WO 2005/039361 | A2 | | 5/2005 | |

OTHER PUBLICATIONS

International Search Report for International Application No. PCT/US2011/055607, dated Apr. 30, 2012, 3 pages.

Corporate Spaces, Inc., "Office Chairs" brochure [online] [retrieved on May 11, 2011], authors unknown, 7 pages.

Paul Allie and Steven Reinecke, "Supporting Natural Human Motion While Seated," Steelcase brochure, date unknown, 5 pages.

Swing Chair by SmartMotion Technology, "You're Going to Love Your SwingChair," [online] [retrieved from internet: URL http://www.swingchair.com/store/home.php] [retrieved on Feb. 15, 2010], 2 pages.

* cited by examiner

ERGONOMIC ADJUSTABLE CHAIR MECHANISMS

This application claims priority of U.S. provisional application Ser. No. 61/251,050, filed Oct. 13, 2010.

FIELD OF THE INVENTION

This invention relates to chairs and stool mechanisms including those adapted for use in a work environment.

BACKGROUND

Among the objectives of ergonomic chairs, particularly work chairs, is to support the user in a posture that reduces strain and tends to maintain the spine in a "neutral" position, that is, a posture in which the spine is aligned to enable the seated user to work comfortably for prolonged periods of time. Most chairs are configured to support the sitter, at least initially, in a position with a thigh to torso angle (the "seating angle") of between about 90-110 degrees. Depending in part on the physical condition of the user it may become fatiguing or even painful to maintain this position for a long period of time. It becomes desirable and more comfortable to sit in an increasingly more open seating angle approaching an optimum neutral posture in which the seating angle is of the order of about 130 degrees. If a chair is not adapted to permit the user to increase his seating angle, he may try to compensate, for example by sliding forward on the seat, thus leaving the lower portion of the back unsupported. Over time, this can cause discomfort or even injury. Should the user wish to maintain an upright position, he may perch on the front edge of the seat in order to angle his thighs downward to increase the seating angle. In this position, however, the user gains no benefit from the back support of the chair and because the front edge of the seat typically is not designed to support the full load of a seated person, this position can become uncomfortable over time.

Many chairs are designed to allow for increasing the seating angle by providing a chair back that can move back with the user's torso to support the back, the increased angle between the chair back and seat providing support for a more comfortable seating angle. Such chairs typically have any of a variety of complex devices such as synchronized linkages as may be found in the Aeron Chair from Herman Miller which uses a heavy spring to counterforce the back support. Another type of back reclining device is a reclining seat lift apparatuses such as offered in the Freedom chair from Humanscale, or the Life chair from Knoll, which uses the user's weight to counterbalance a rearward leaning back and enable the user to recline their torso away from their thighs.

Such reclining-back chairs may tend to have deep seats, which make it difficult or impossible for the sitter to lower his thighs; consequently the sitting angle becomes reduced should the user desire to lean forward toward a work surface. Additionally, there is often little or no back support for a user in forwardly leaning positions. The mechanisms in such chairs typically are designed to tilt the sitter away from the work surface making difficult to access the work surface and tools in reclined positions.

SUMMARY OF INVENTION

It is among the general objectives of the invention to provide a seating mechanism by which a seat or thigh support can be tilted forward entirely under the control of the user while the user's spine and pelvis are maintained in a vertically aligned position and to do so without the use of springs or other force-balancing devices. The invention allows the user to control his seating angle with his thighs while maintaining proper spine and pelvic posture. Additionally, the invention enables the user to shift position toward the work surface as the seating angle is increased. An additional objective of the invention is to require a progressively reducing thigh force to maintain the position of the chair as the seating angle increases.

In one aspect of the invention the seating mechanism includes a frame that supports a seat having two segments including a thigh support and a cradle adapted to receive the user's pelvis. The thigh support is pivotally mounted between its ends, in seesaw fashion, to the forward portion of the frame, at a first pivot axis. The thigh support has forward and rearward extending portions located forwardly and rearward of the first pivot axis, respectively. The pelvic cradle is pivotally suspended about from the rearward portion of the thigh support about a second pivot axis. The front end of the thigh support is adapted to support the user's thighs while the pelvic cradle is shaped to receive the user's pelvis and support the torso in vertical alignment with the pelvis. The seating angle is adjustable by the user shifting the extent to which his thighs bear on the front portion of the forward segment. The first and second pivot axes and the length of the forward end of the first segment are arranged to define a mechanical advantage sufficient to enable the user to use the weight of the thighs to counterbalance the weight of his torso and pelvis through the full range of seating angles. As the seating angle increases the pivots that support the cradle rise and shift forwardly to raise the cradle slightly and move the user forwardly, closer to a work surface. As the pivots approach vertical alignment the force of the thighs necessary to maintain position reduces progressively. In one embodiment of the invention the cradle is permitted to pivot freely about the second pivot axis. In another embodiment the cradle is connected to the frame via a stabilizing link that cooperates with the thigh support to form somewhat of a parallel bar linkage by which the pelvic cradle is maintained in a substantially constant attitude throughout the range of movement of the chair. By maintaining a constant attitude for the cradle the spine may be aligned with the pelvis throughout the range of movement of the mechanism. The mechanism may be used in a stool configuration or may include a chair back and arms connected to the cradle.

In another aspect of the invention the chair includes a chair seat and a chair back. The chair seat is pivoted at a first pivot to provide forward and rearward extending segments. The chair back is pivoted the second pivot to the rearward portion of the seat and a stabilizing link is pivotally connected at one end to the frame and at another end to the back of the chair. In this arrangement the seat may tilt forward under the influence of pressure applied by the user thighs while the parallelogram linkage maintains the chair in an upright attitude throughout its range of movement to support the user in a posture in which the spine and pelvis are in proper vertical alignment.

In a further aspect of the invention the chair mechanism includes a seat or a thigh support that are supported by a scissors mechanism that includes a parallelogram linkage extending from the frame to the rear portion of the cradle or seat back in order to maintain the cradle and seat back in an upright position with the spine in alignment with the pelvis. A second control link connects the rear portion of the frame with the forward portion of the seat or thigh support to guide the forward end of the seat in a downward, arcuate path to enable the user to increase the seating angle while the parallelogram connection between the frame and the pelvic cradle or seat back maintains the cradle or seat back in a constant attitude. In this embodiment the thigh support or chair seat may be considered as having a movable virtual pivot point that is movable through the range of motion of the chair.

DESCRIPTION OF DRAWINGS

The invention will be appreciated more fully from the following further description of the invention in which.

DESCRIPTION OF THE ILLUSTRATIVE EMBODIMENTS

Figure 1:
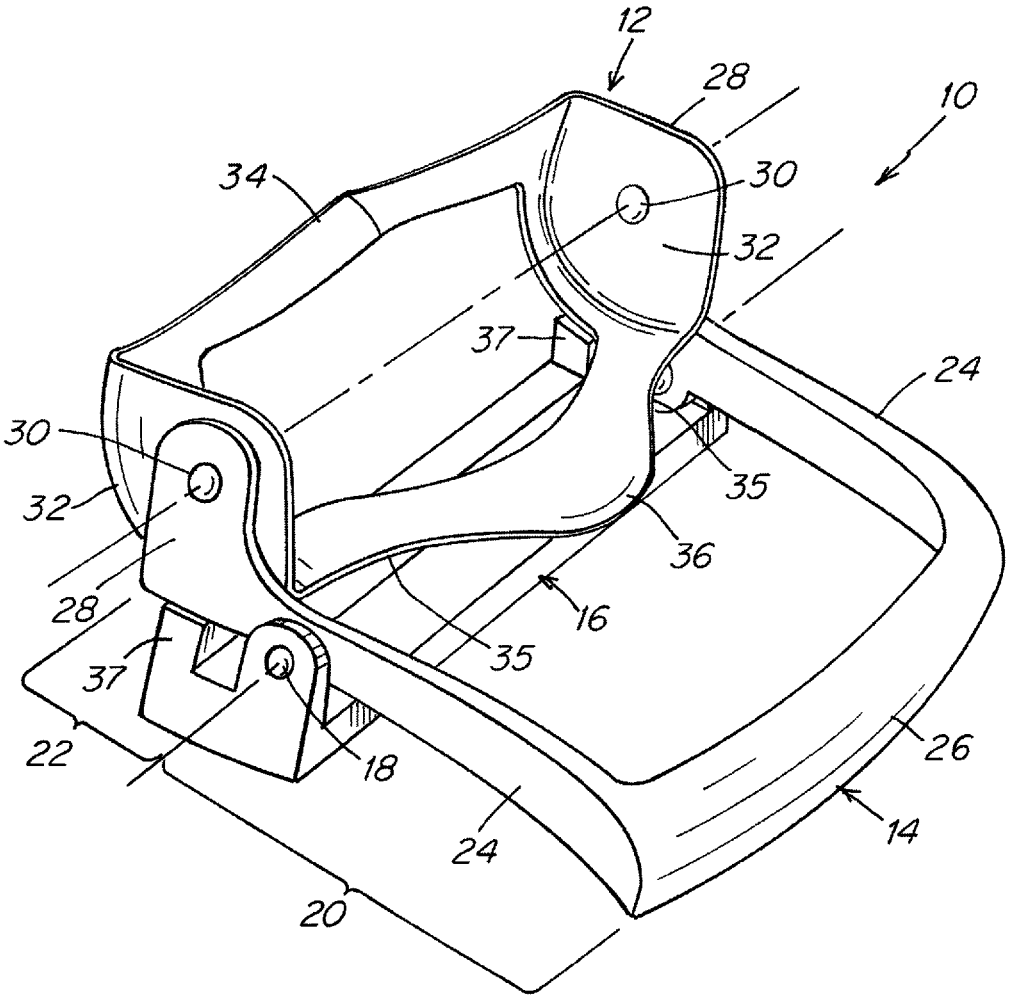
FIG. 1 is a diagrammatic illustration of a cradle mechanism in accordance with the invention.
Figure 2:
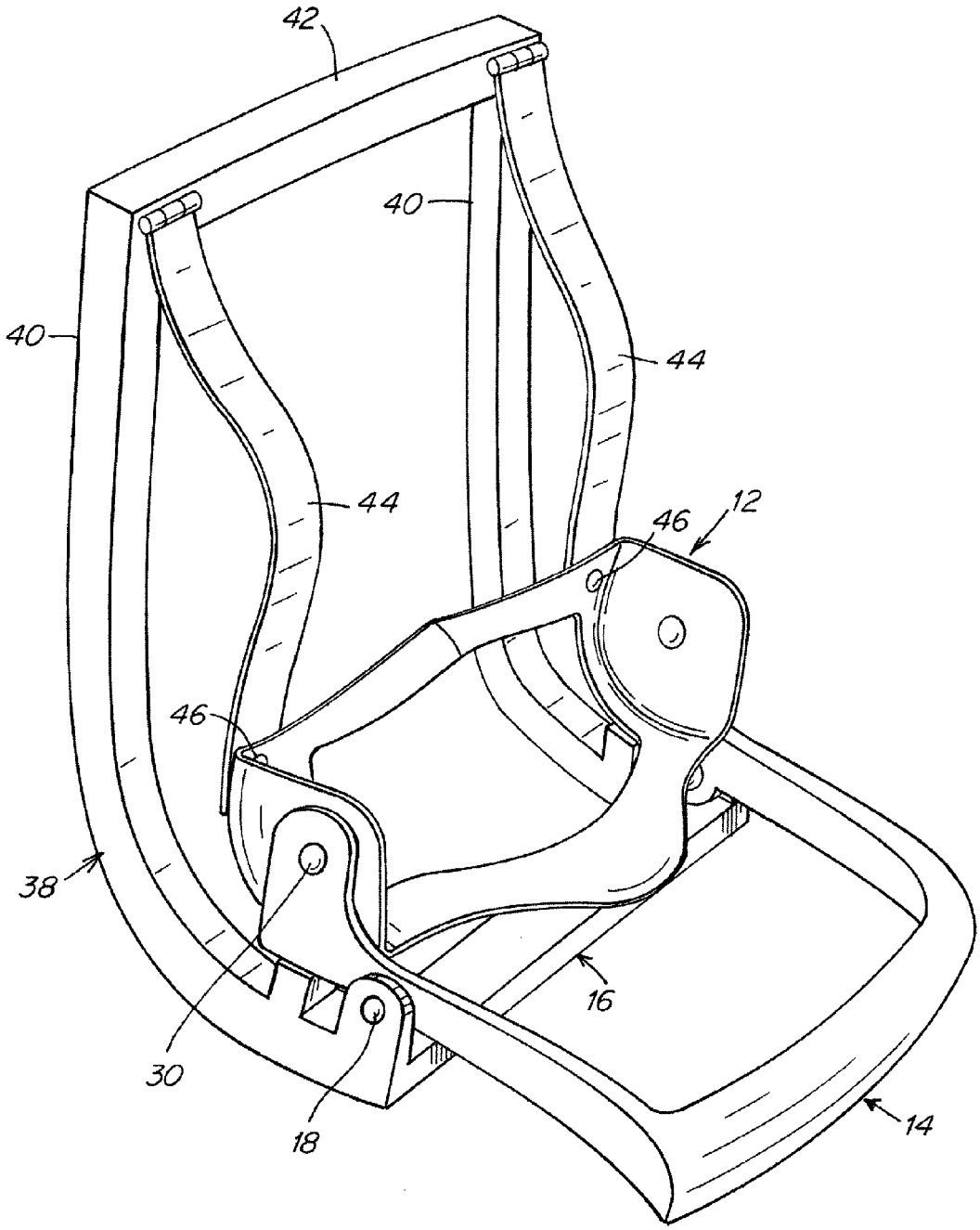
FIG. 2 is a diagrammatic illustration of the cradle mechanism incorporated into a chair having a variable lumbar support.

As shown in FIGS. 1 and 2 one embodiment of the seating mechanism includes a two-piece structure 10 including a pelvic cradle 12 and a thigh support 14 to which the pelvic cradle 12 is mounted. The thigh support 14 is pivotally mounted between its ends on a rigid frame 16 at a pivot axis 18 and may be considered as having forward and rearward portions 20, 22 relative to the pivot axis 18. As shown in the drawings, the thigh support 14 may, for example, comprise a pair of laterally spaced members 24 connected at their forward ends by a transversely extending crossbar 26. The rearward portions of the thigh support include a pair of trunions 28 having a pair of transversely spaced pivots 30 that define a second pivot axis. The pelvic cradle 12 includes side members 32 by which the cradle is pivotally mounted at pivots 30, enabling the cradle to pivot about the second pivot axis 30-30. The side members are connected by transverse back and front members 34, 36 to provide support without interfering with the ability of the user's thighs to extend forwardly. The transverse front member 36 of the pelvic cradle may be considered as being somewhat in the shape of a bicycle seat in which hollow or cut-away regions 35 are defined on each side of the transverse front member 36. It should be understood that other cradle configurations may be employed. A stop 37 is provided on one of the frame 10 or rearward portion of the thigh support to limit the extent to which the thigh support can pivot rearward.

The distance between the pivot axis 18 and the forward region of the thigh support 14 where the resultant thigh force is applied (center of effort) is sufficiently greater than the distance between the first and second pivot axes, 18, 30 to provide sufficient mechanical advantage by which a user seated in the pelvic cradle will be able to balance the weight of the torso by the weight applied by the user to the thigh support. By way of example only, I have found that suitable dimensions may include a horizontal distance between the first and second pivot axes of about 2¼ inches, a vertical distance between first and second pivot axes of about 3¾ inches and a horizontal distance of 6¾ inches (or more) from the first pivot axis to the center of effort. The pelvic cradle is mounted on its pivots 18 so that it tends to assume a relaxed position in which a user seated in the cradle may be supported with his torso and pelvis in vertical alignment while allowing free movement of the user's hip joint and thighs to vary the seating angle as desired. The ability of the pelvic cradle to pivot freely in this embodiment enables the user to make slight adjustments to the portion of the uses by weight to be applied to the bar. As the thigh support pivots forwardly the cradle rises and moves forward while the knees move downward, increasing the seating angle while enabling the user to maintain vertical alignment of his spine and pelvis. It should be noted that as the pivot axis moves closer to vertical alignment with the pivot axis 18 the applied force of the thighs becomes progressively less. Thus the thigh force required to maintain a selected increased seating angle is reduced.

Figure 3:
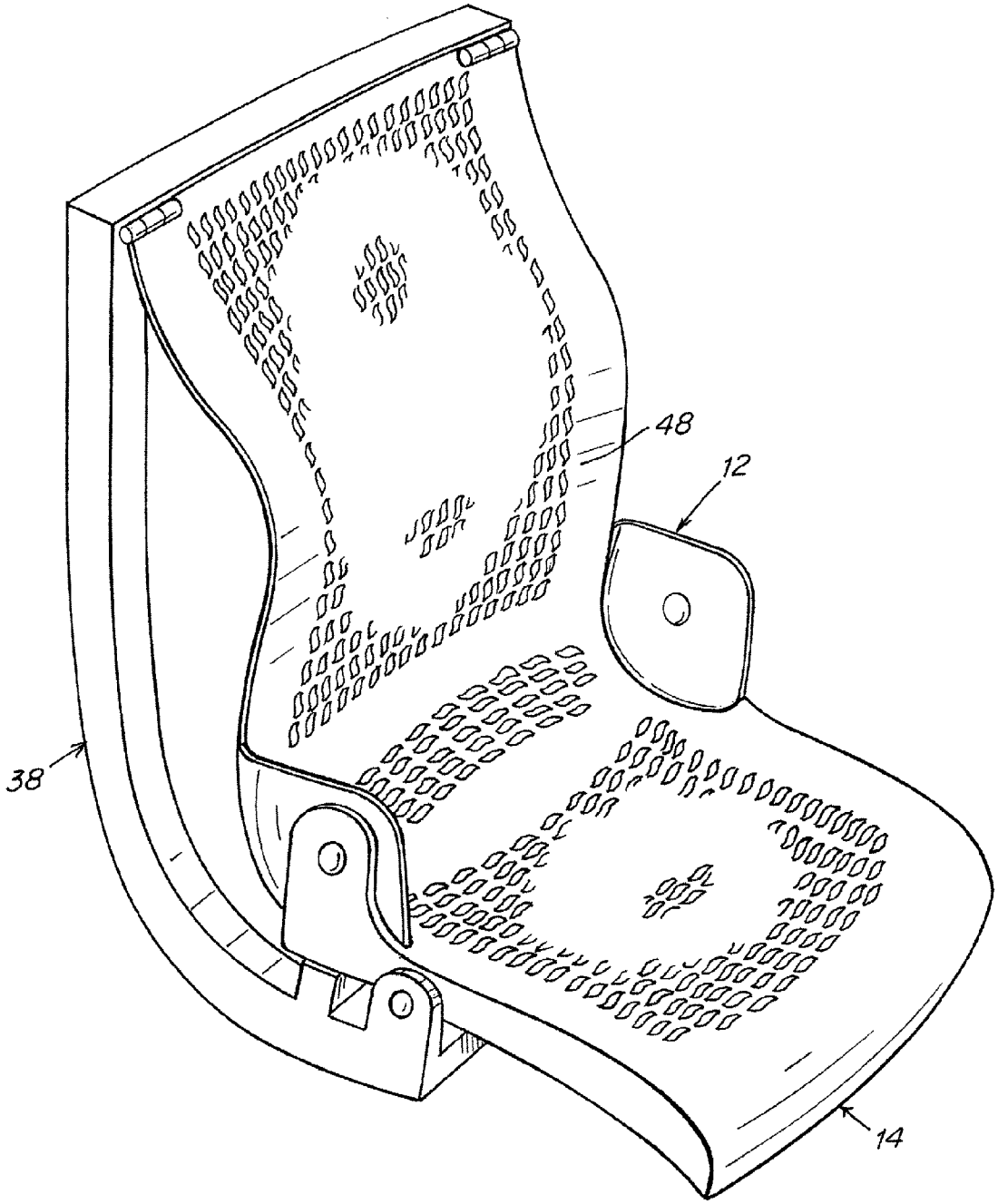
FIG. 3 is a diagrammatic illustration of a chair as shown in FIG. 2 with an expandable membrane covering the seating and back portions of the chair.
Figure 4:
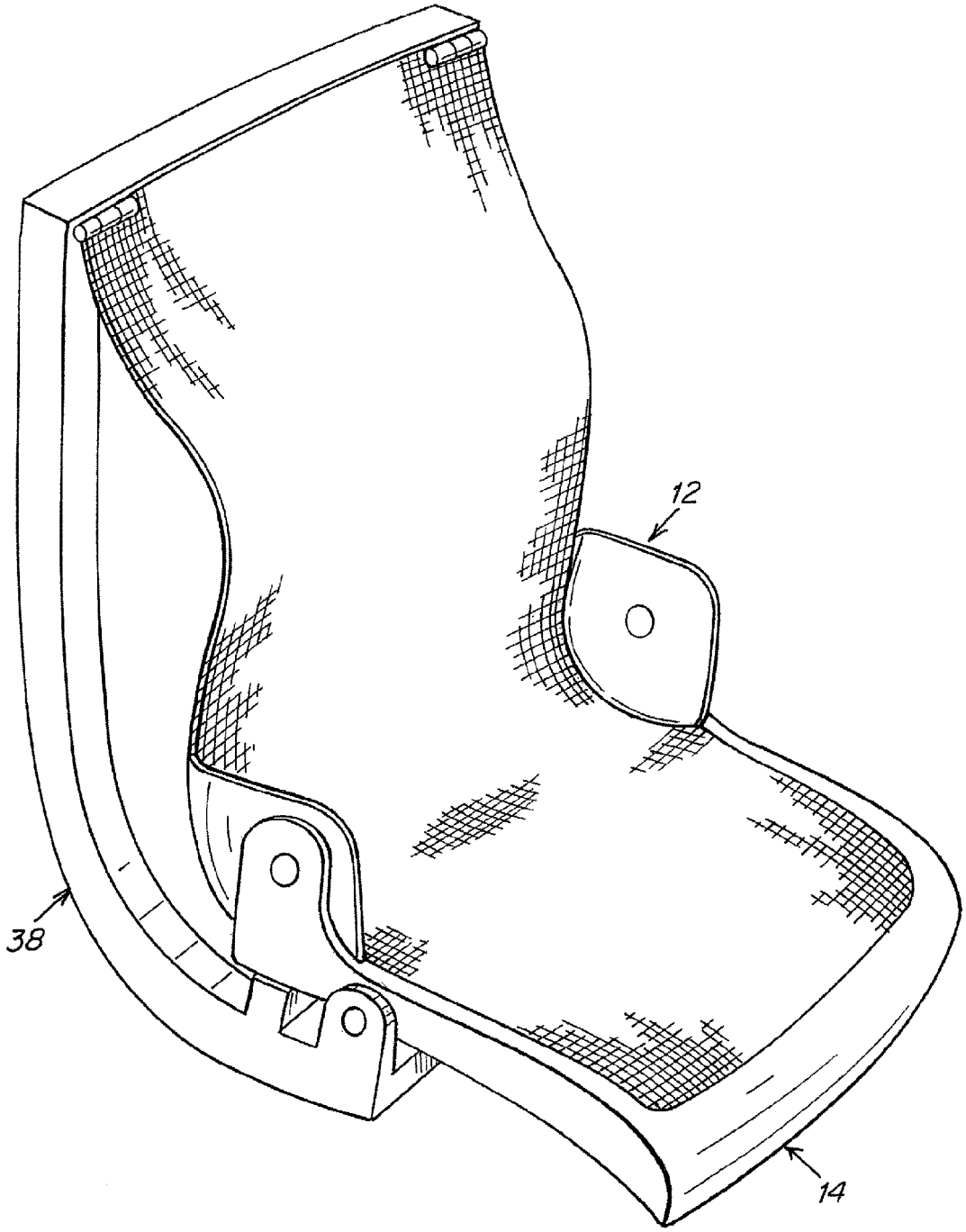
FIG. 4 is an illustration similar to FIG. 3 in which an elastic fabric or membrane covers the chair.
Figure 5:
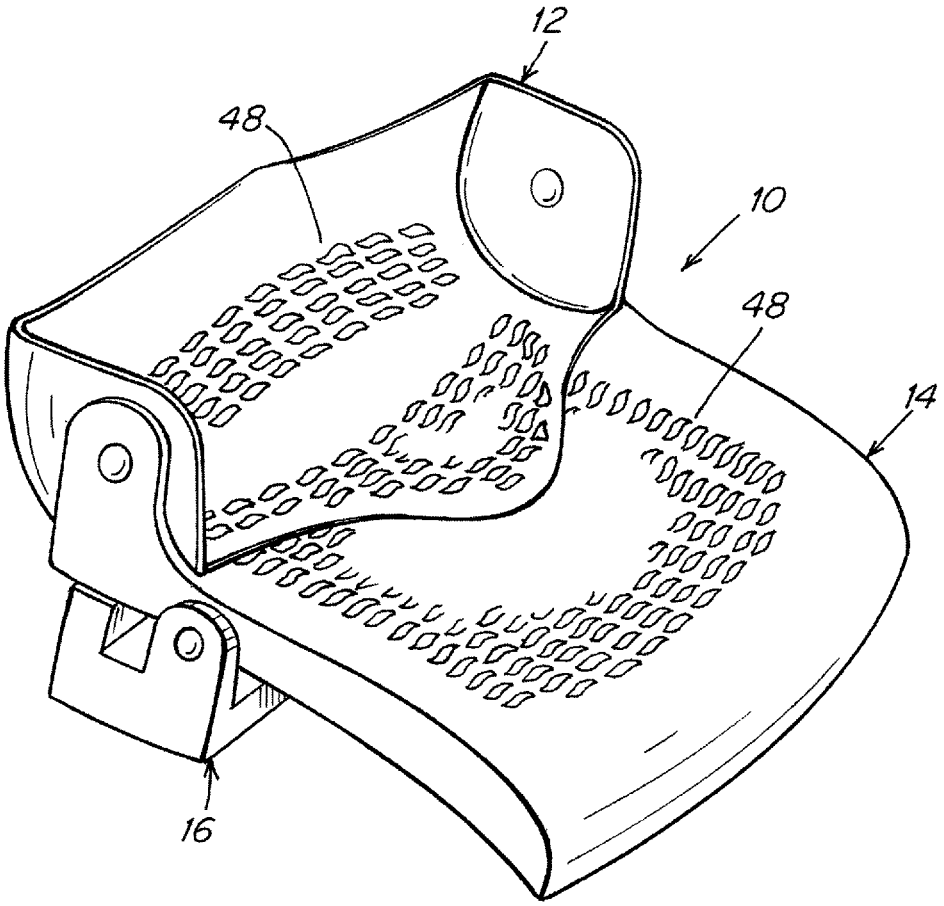
FIG. 5 is a diagrammatic illustration similar to FIG. 1 in which an expandable membrane is integrated with the pelvic support and the front seat.
Figure 6:
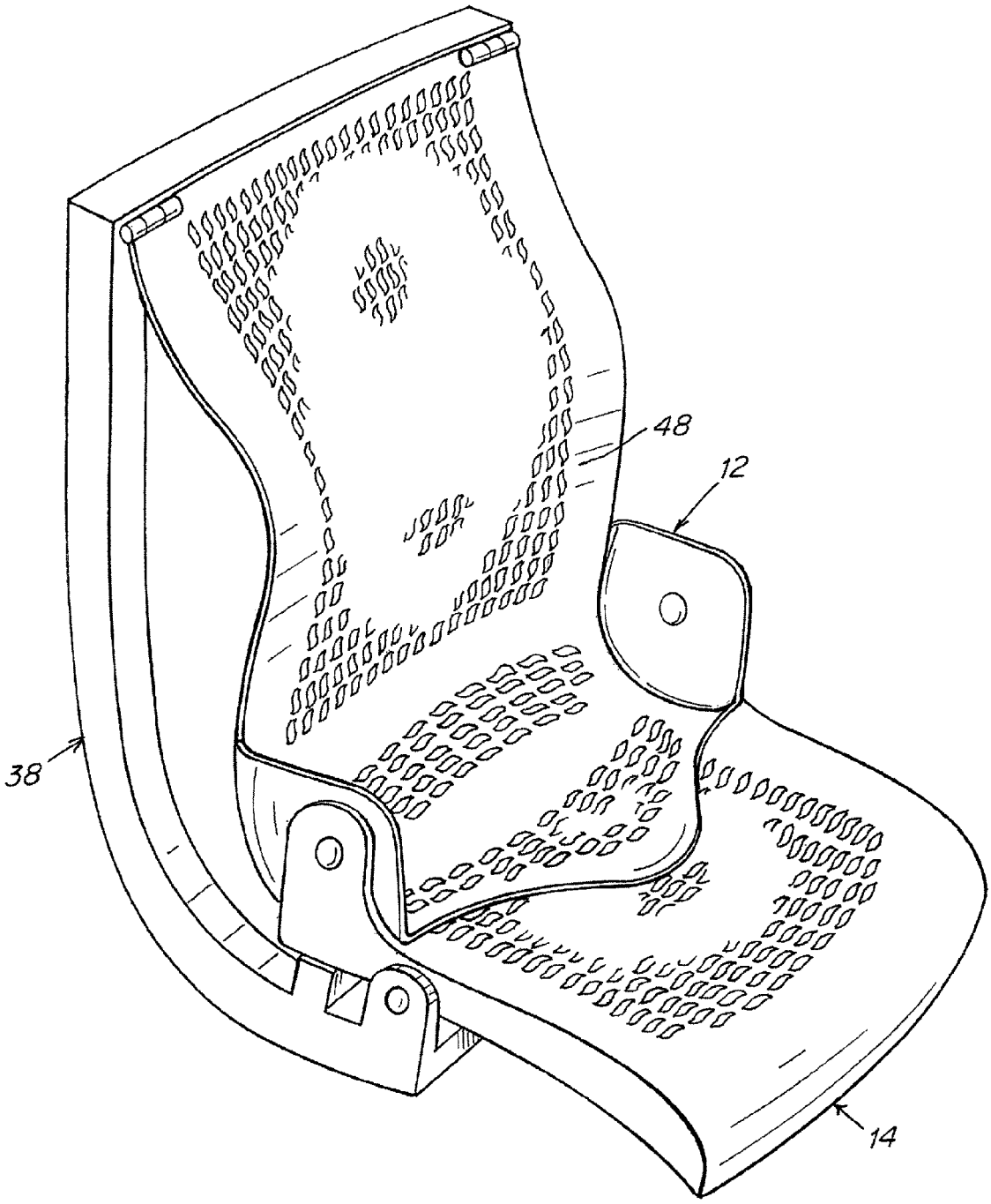
FIG. 6 is a diagrammatic illustration of another embodiment of the chair in which expandable membranes are integrated with the seat back and the pelvic cradle.

FIG. 2 illustrates, diagrammatically, the invention as embodied in a chair, and particularly the type of chair described in U.S. Pat. No. 7,695,067 dated Apr. 13, 2010, and entitled "Ergonomic Adjustable Chair," the disclosure of which is incorporated by reference in its entirety. In this embodiment the frame 38 includes an upstanding back portion 40 and a crossbar 42 at the top. As described in the aforementioned patent, the chair includes a pair of elongate profile bands 44 that extend downwardly from the upper end of the back portion of the frame 38. In the embodiment of FIG. 2, the lower ends of the profile bands are attached, at 46, to the pelvic cradle 12, preferably to upper portion of the pelvic cradle. The profile bands 44 are maintained in longitudinal compression and serve as a support for the user's lumbar region by an elastic fabric or membrane attached to the profile bands and spanning the back of the chair. In other applications of the invention, such as in FIG. 3, a more rigid, but expandable membrane 48 may be provided. In this embodiment of the chair the profile bands and seatback connected to the bands provide the user with a back support throughout the range of motion from the rest to forward tilt positions of the device as illustrated in the drawings. The profile bands may vary in shape to offer a corresponding support profile to the user's back as he adjusts his position on the chair as explained in further detail in the aforementioned patent.

Figure 7C:
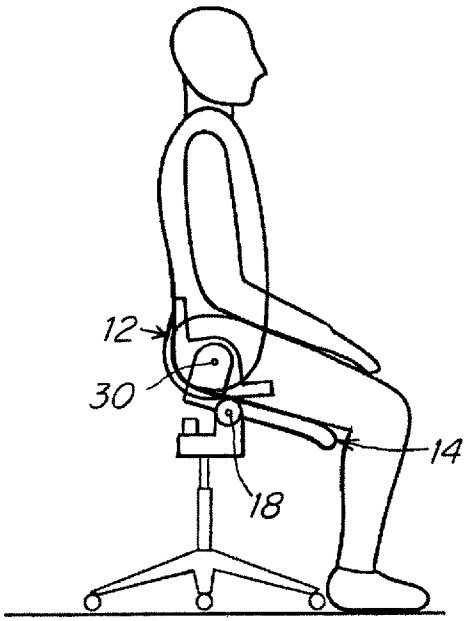
FIGS. 7A-7C are diagrammatic side views of a stool and embodying the invention and illustrating the stool in resting, forward tilt and neutral posture positions, respectively.
Figure 7B:
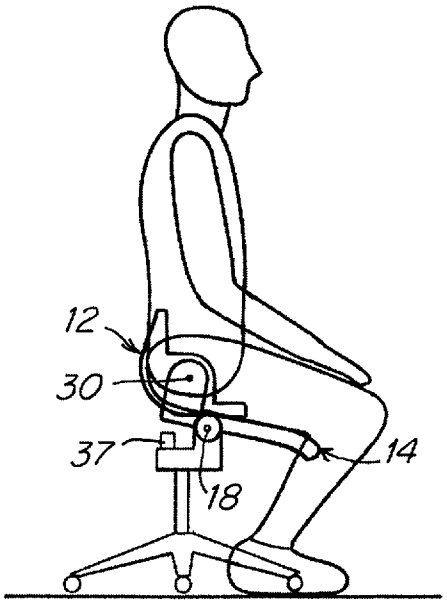
Figure 7A:
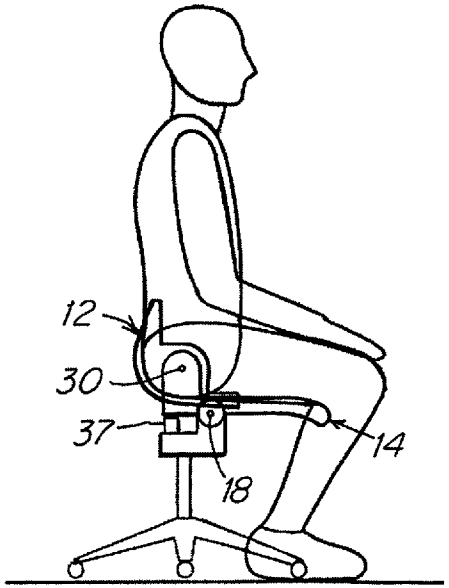

FIGS. 7A-7C illustrate, diagrammatically, a user seated on a stool incorporating one embodiment of the invention, with the user being illustrated in seating positions having progressively increasing seating angles. These include a rest position (FIG. 7A), a forward tilt position (FIG. 7B) and a neutral posture position (FIG. 7C). The thigh support is shown as being progressively inclined as the seating angle increases. In all positions, the pelvic cradle self-adjusts about its pivot axis so that in all positions it provides support for the user's pelvis and torso. In the resting position (FIG. 7A) the user's thighs are parallel to the floor and the user can sit flat, or, by tilting the pelvic cradle, can independently rock his torso easily rearward and forward at the hip joint without raising the front of the seat. In the forward tilt position (FIG. 7B), the user can increase the seating angle by tilting the thigh downward against the thigh support. The mechanical advantage achieved by the relative positioning of the pivots 18, 30 and the forward extension of the thigh support enable the shifting of the weight of the thighs to raise or lower the user's torso relative to his legs thereby increasing the seating angle. The pelvic cradle is contoured to cradle the users pelvis and its pivotal connection to the rear portion of the thigh support enables it to maintain a level position independently of the position of the thigh support. By maintaining a level orientation for the pelvic cradle the user will not slide out of the cradle or off the seat even if the thigh support is angled downward, as shown. Additionally, to facilitate the user's accommodation of different tasks, the user can easily pivot forward and backward to independently adjust the angle of the torso on the pelvic cradle while the cradle is in a lifted position but without changing the angle of the thigh support.

Figure 8B:
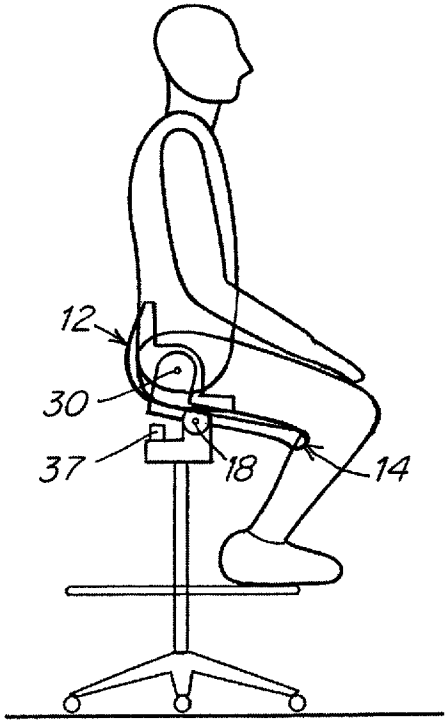
FIGS. 8A and 8B are diagrammatic side views of a drafting height stool, showing an embodiment of the invention mounted on a higher base with a foot rest in resting and forward tilt positions, respectively.
Figure 8A:
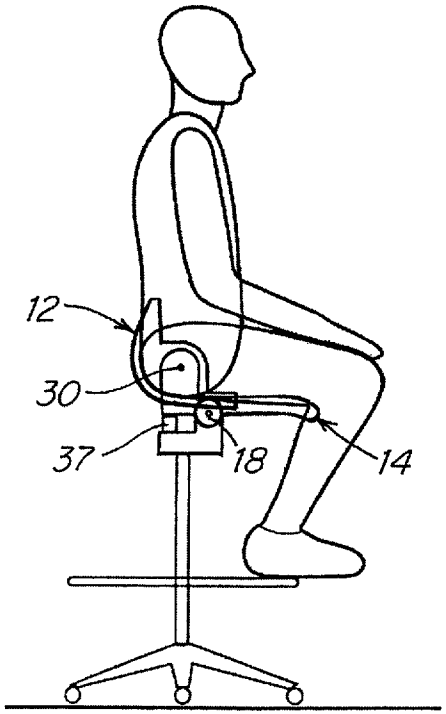

FIG. 7C illustrates a user on a stool in a neutral position. The frame of the stool may incorporate a seat lifting arrangement, such as a standard pneumatic gas lift, to allow the user's thighs to drop further, to further open the seating angle should that be desired FIGS. 8A and 8B illustrate a drafting height stool incorporating the invention. The seating arrangement is mounted on a higher base with a footrest that is intended to accommodate raised applications such as drafting tables or copyright surfaces.

Figure 9D:
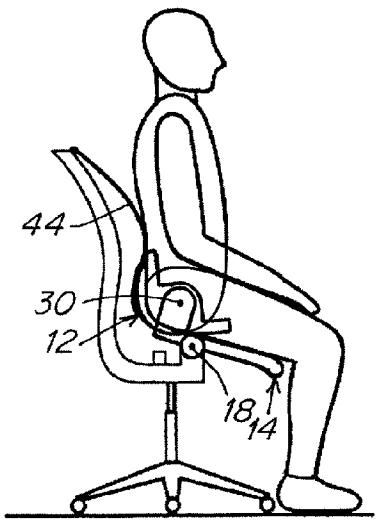
FIGS. 9A-9D are diagrammatic side views of an ergonomic work chair embodying the invention and illustrating the chair and user in off-load, resting, forward tilt and neutral posture positions, respectively. The chair includes profile bands.
Figure 9C:
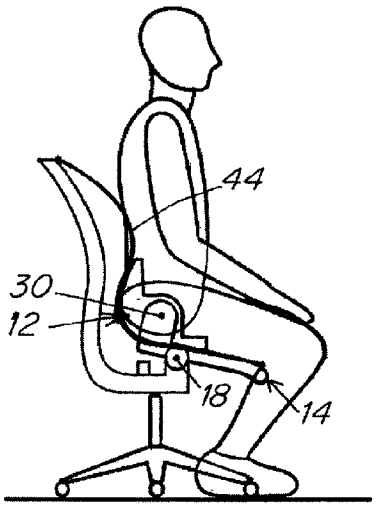
Figure 9B:
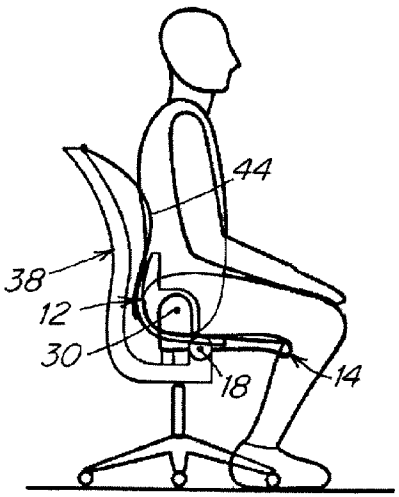
Figure 9A:
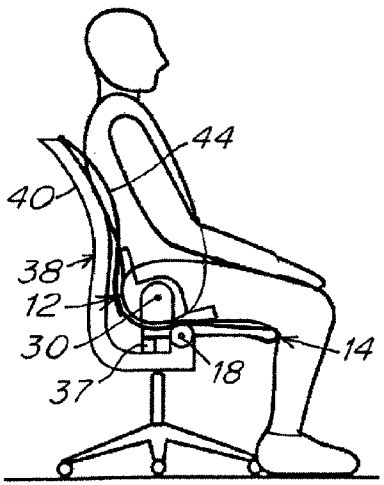

FIGS. 9A-9D illustrate, diagrammatically, the invention as incorporated into an ergonomic chair such as that described in connection with FIG. 2. FIG. 9A illustrates the user in a chair in off-load position in which the user's thighs are approximately parallel to the floor with the user reclining rearward to offload the weight of the torso onto the backrest but without raising the thigh support. This motion is permitted by the independent pivotal capability of the pelvic cradle. In this position relief may be obtained from vertical, compressive stresses on the spine. FIG. 9B shows a user and the rest position in which the user's thighs are substantially parallel to the floor and his back is supported by the profile bands. FIG. 9C illustrates the user with the chair in the forward tilt position in which the seating angle has been increased by tilting the thighs downwardly against the thigh support. Because of the mechanical advantage described above, the weight of the thighs can be used to counterbalance the weight of the user's torso by simply dropping or lifting the thighs. Additionally, the profile bands maintain an appropriate degree of back support. FIG. 9D is a diagrammatic side view of the chair in a neutral position. Here, again, the chair may incorporate a pneumatic gas lift to raise the chair higher and allow the user's thighs to drop to further open the seating angle.

Figure 10A:
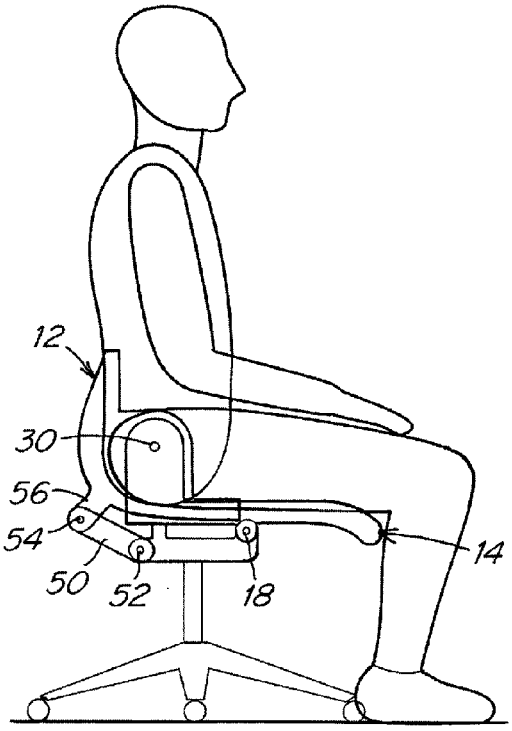
FIGS. 10A and 10B are diagrammatic illustrations of a stool mechanism with an additional link to stabilize the attitude of the pelvic cradle throughout the range of operation of the mechanism.
Figure 10B:
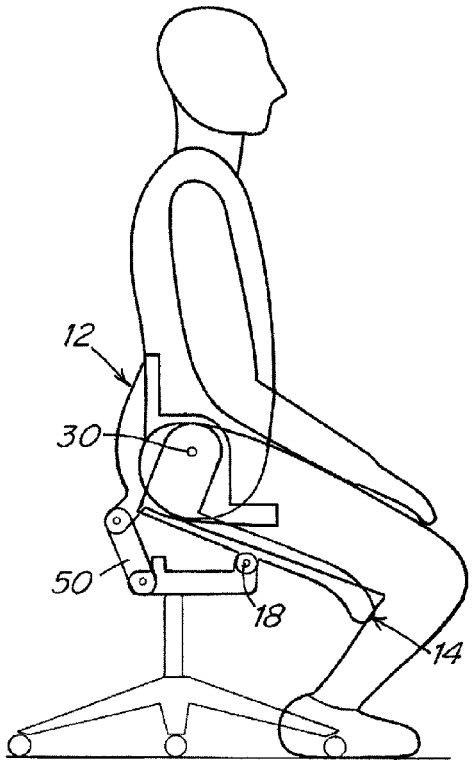

FIGS. 10A and 10B illustrate, diagrammatically resting and forward tilt positions of a stool mechanism similar to that described above, further modified to include a stabilizing link 50 to maintain that the attitude of the pelvic cradle constant throughout the range of motion of the mechanism. Stabilizing link is pivoted at one end, at a pivot 52 to a rear portion of the frame 16. The other end of the stabilizing link 50 is pivoted at 54 to the cradle, as by a lug 56 extending from the cradle or other suitable connection means. The links connecting the pivots 52, 54 and 18, 30 define a substantially parallel bar linkage that maintains the constant attitude of the cradle. Thus, a person seated with his pelvis supported in the cradle can maintain alignment of the spine with the pelvis throughout the motion between the resting position and the forward tilting position, as shown.

Figure 11A:
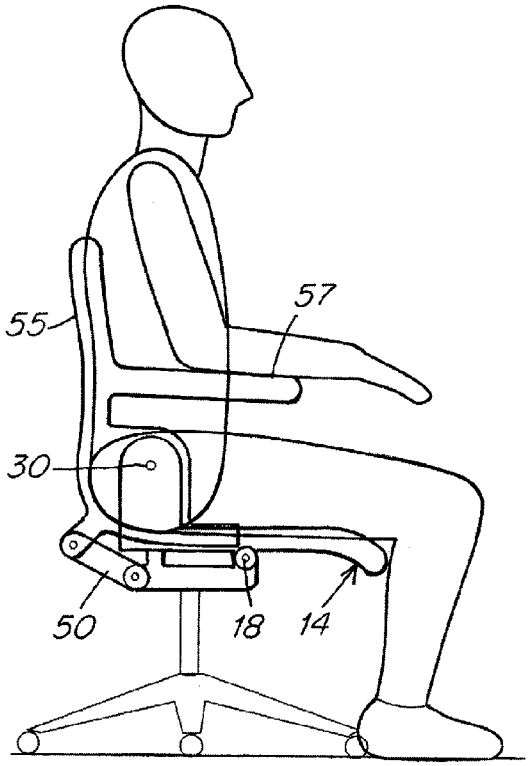
FIGS. 11A and 11B are diagrammatic illustrations of the chair mechanism with an additional link to stabilize an integrated arm, back and pelvic cradle and illustrating a resting position and a forward tilting position.
Figure 11B:
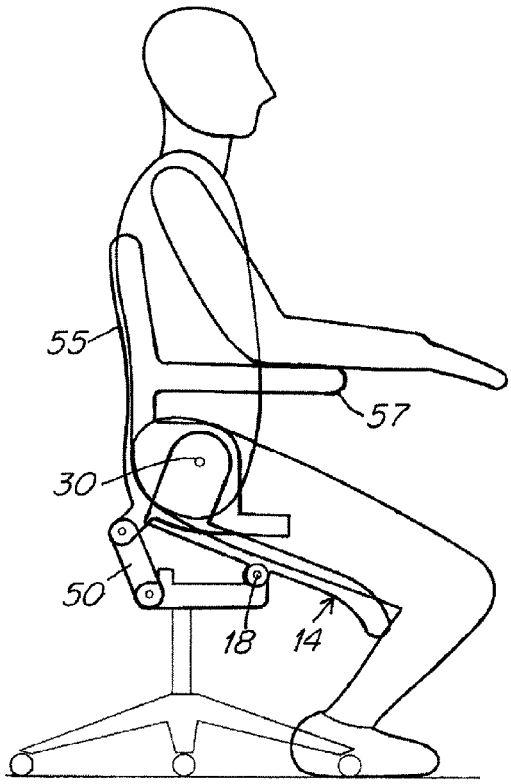

FIGS. 11A and 11B illustrate the mechanism of FIGS. 10A and 10B modified to add an integrated back 55 and arm 57 to the cradle and in which the stabilizing link 50 is provided to function as described above.

Figure 12A:
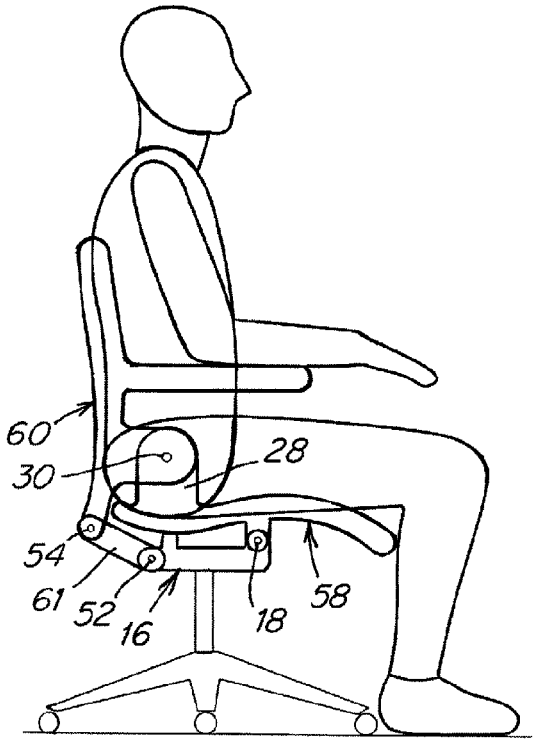
FIGS. 12A and 12B are diagrammatic illustrations of a chair having a separate one piece contoured seat and integrated arm and back components and with a stabilizing link connecting the frame with the integrated arm and back, shown in resting and forward tilt positions, respectively.
Figure 12B:
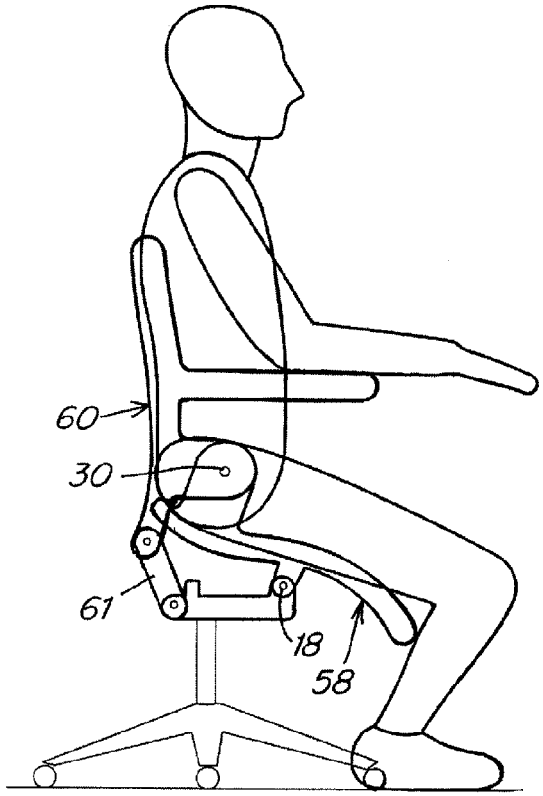

FIGS. 12A and 12B illustrate, respectively, the rest and forward tilt positions of another chair embodiment of the invention in which the cradle is omitted. Instead, the chair includes a single contoured seat 58 pivoted at a first pivot 18 to the frame. A pair of laterally spaced trunnions 28 integral with the rear portion of the seat 58 extend upwardly from the seat and are pivotally connected to an independent, integrated chair back and arm unit 60 at a pivot axis. The chair back is movably connected to the frame by a stabilizing link 61 extending from the rear portion of the frame to the lower end of the unitary chair back. The arrangement of links and pivots 18, 30 and 52, 54 defines the parallel bar configuration that functions to maintain the user properly postured throughout the range of motion of the chair. The contour of the rear portion of the one-piece seat 58 is depressed to provide support for the user's pelvis, particularly when in the forward tilting position (FIG. 12B) to prevent the user from sliding forward on the seat.

Figure 13A:
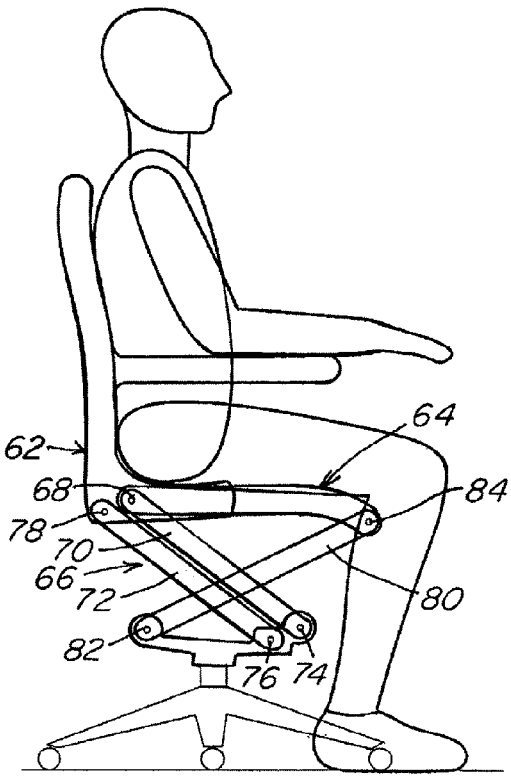
FIGS. 13A and 13B are diagrammatic illustrations of another embodiment of a chair mechanism, in resting and forward tilt positions, in which the user can maintain proper seating posture while controlling the seating angle with thigh pressure, the mechanism including a pair of parallel rearward extending stabilizing links and a forwardly extending guide link controlling the position of the front of the thigh support.
Figure 13B:
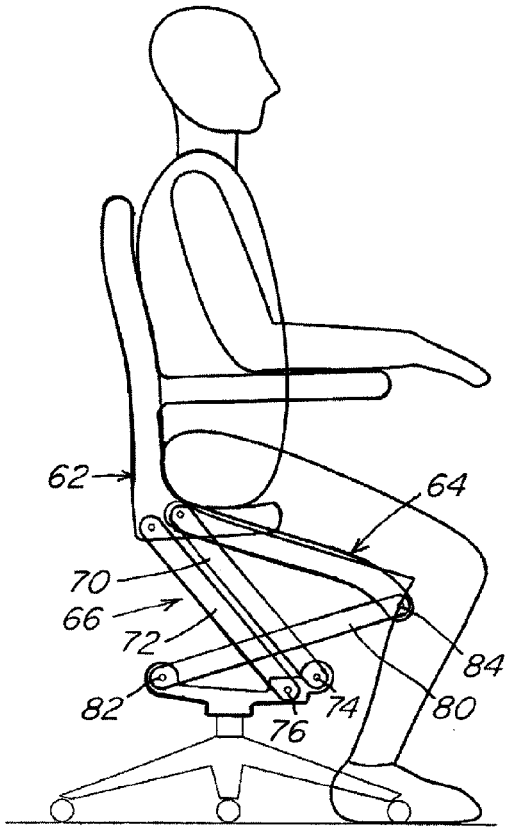

FIGS. 13A and 13B illustrate, diagrammatically, another embodiment in which the chair includes a pelvic cradle with an integrated chair back and armrest unit 62 adapted to move as a unitary structure and a thigh support 64 that is pivoted at its rear end at pivot axis 68 to the unit 62, preferably at the lower region of the back or rear portion of the integral cradle. The thigh support 64 and unitary chair back and cradle 62 are supported by a linkage mechanism 66 that maintains the unitary structure 62 in a constant attitude while the thigh support 64 is urged downwardly to increase the seating angle. The mechanism includes a pivotal connection 68 between the rear of the thigh support 64 and the unitary structure 62. The pivot 68 is located in the region of the juncture between the cradle and back of the unitary structure 62. The constant attitude of the unitary structure 62 is maintained throughout the range of motion of the chair by a parallel bar linkage that includes a pair of parallel links 70, 72 connected at one end to the forward portion of the frame 16 at pivots 74, 76. The other ends of the links 70, 72 are connected at pivots 68, 78 to the unit 62 at its lower rear portion. The mechanism 66 also includes a guide link 80 that connects the rear of the frame 16, at pivot 82, to the forward end of the thigh support 64 at a pivot 84. The guide link 80 guides the front end of the thigh support 64 along a circular arc different from the circular arc along which the unitary structure 62 is guided by the parallel bar linkage. It may be noted that guiding the ends of the thigh support 64 along the different arcs results in an effective virtual pivot point below the thigh support about which the thigh support rotates. The virtual pivot point itself shifts in space as the mechanism is operated through its range of motion.

Figure 14A:
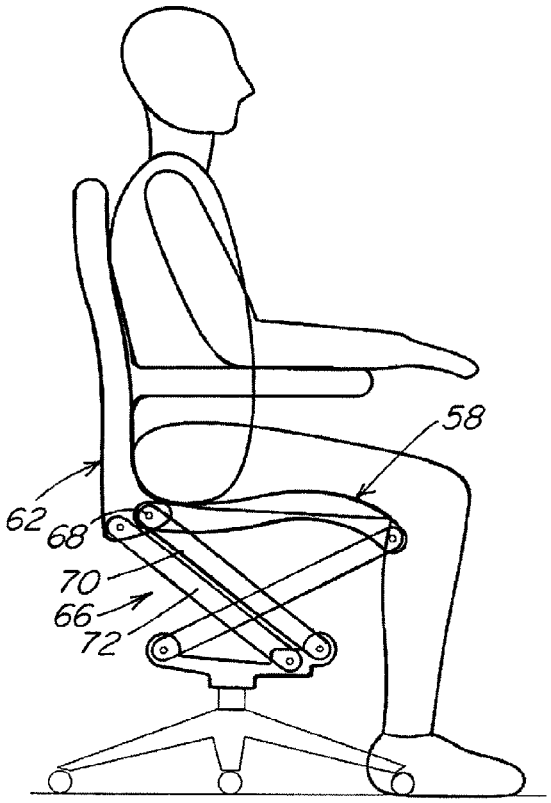
FIGS. 14A and 14B are diagrammatic illustrations of a chair mechanism with a one piece contoured seat and an integrated arm and back component having a front guide link and a pair of rearward extending stabilizing links.
Figure 14B:
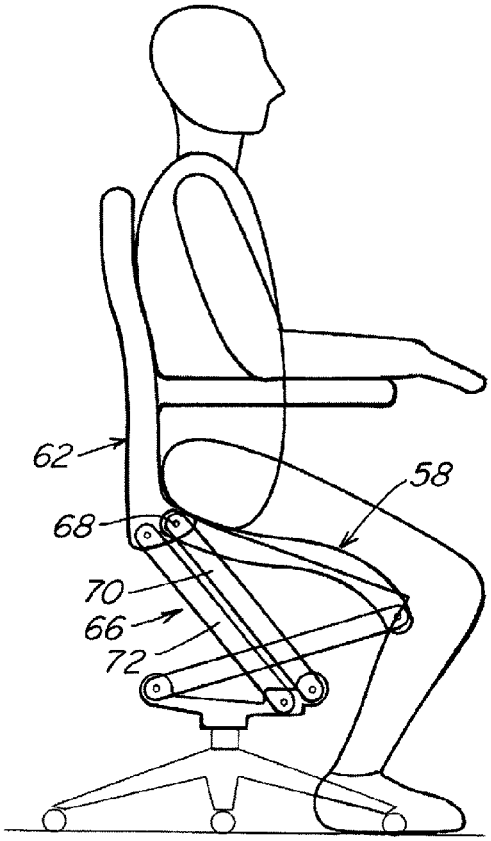

FIGS. 14A and 14B are diagrammatic illustrations similar to FIGS. 13A and 13B but with the cradle portion of the unitary structure 62 being removed. Instead, the chair is provided with a full contoured seat 58 that is connected directly to the unitary back and arm structure at pivot 68. The operation of the mechanism 66 is the same as described above in connection with FIGS. 13A and 13B except that a depression is formed in the rear region of the seat to maintain support for the user's pelvis when in the forward tilting position.

Figure 15A:
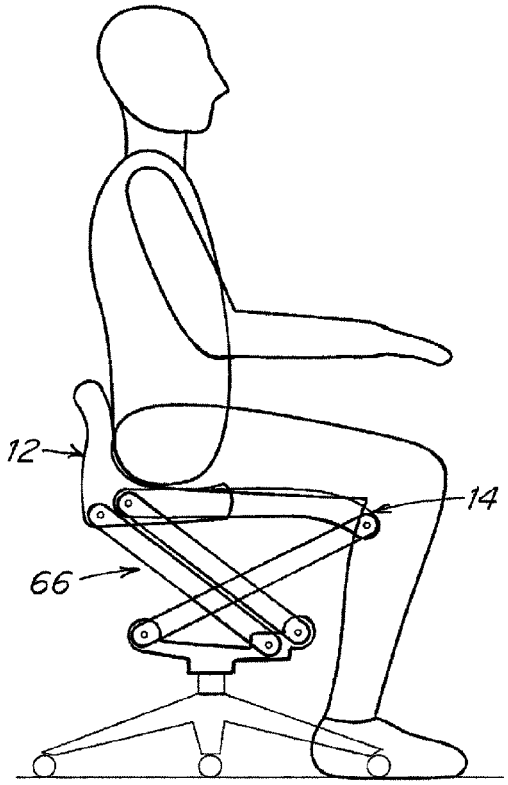
FIGS. 15A and 15B are diagrammatic illustrations of a stool having a mechanism similar to that of FIG. 13 and showing the stool in resting and forward tilting positions, respectively.
Figure 15B:
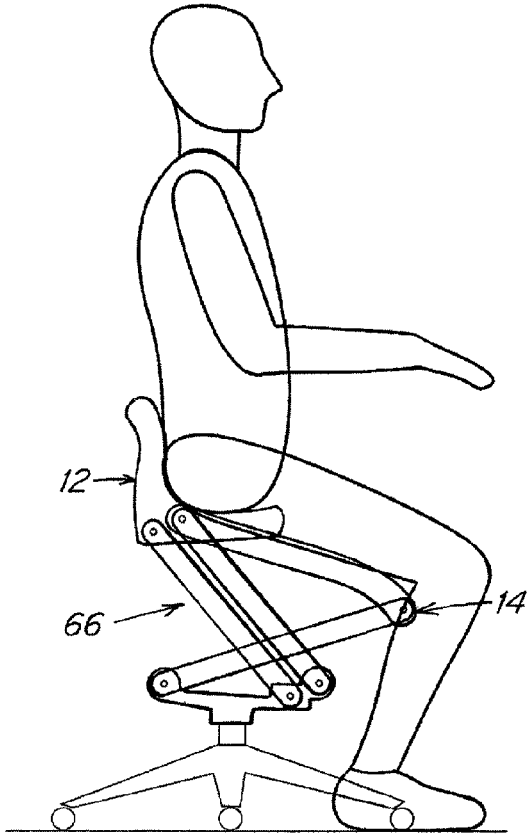

FIGS. 15A and 15B illustrate, diagrammatically, a seating mechanism similar to that of FIGS. 13A and 13B in a stool configuration without the unitary back and arm structure.

It should be understood that the foregoing description of the invention is intended merely to be illustrative and that other embodiments, modifications and equivalents may be apparent to those skilled in the art without departing from the scope of the invention.

I claim:

1. A seating mechanism comprising:

a frame;

a thigh support pivotally mounted to the frame along a transverse first pivot axis, the thigh support having a portion extending forwardly of the first pivot axis and a portion extending rearward of the pivot axis;

a pelvic cradle pivotally mounted at a transverse second pivot axis to the rearward extending portion of the thigh support, wherein the second pivot axis is located rearward of and above the first pivot axis, the cradle being adapted to pivot with respect to the thigh support and being receptive to the pelvic region of a human to support the pelvic region and torso of the user in vertical alignment independently of the inclination of the forward portion of the thigh support, the second pivot axis being movable upwardly and forwardly as the forward portion of the thigh support tilts forwardly, whereby as the thigh support tilts forwardly the second pivot axis is moved forwardly, approaching vertical alignment with the first pivot axis and lessening the force on the thigh support required to maintain the position of the mechanism, wherein the pelvic cradle is connected to the frame by a stabilizing link having a fixed length, the stabilizing link pivoted at one end to the frame at a transverse third pivot axis and at the other end to the cradle at a transverse fourth pivot axis, thereby to stabilize the cradle in a constant attitude throughout the range of movement of the seating mechanism, wherein the transverse third and first pivot axes are spaced apart at a fixed distance;

the thigh support and the first and second pivot axes being located and arranged to provide a mechanical advantage sufficient to enable the user to control the position of the thigh support about the first pivot axis to vary the seating angle of the user while counterbalancing the weight of the user's pelvis and torso by applying thigh pressure to the forward portion of the thigh support.

2. The seating mechanism as defined in claim 1 further comprising a stop member disposed on the frame and engageable with the thigh support to limit the extent to which the thigh support can rotate rearwardly.

3. The seating mechanism as defined in claim 1 further comprising the cradle having a seat portion and a back portion, the seat portion having leg cut-outs at its sides.

4. The seating mechanism as defined in claim 1 wherein the pelvic cradle is free to pivot about the second pivot axis independently of the position of the thigh support.

5. The seating mechanism as defined in claim 1 wherein the stabilizing link and the connections between the first and second pivot axes define a four bar linkage.

6. The seating mechanism as defined in claim 1 further comprising:

the frame including an assembly having a seat segment and a back segment; at least one elongate, flexible, resilient, profile band mounted to the frame at least one fixed location on the frame and having a back segment extending along the back segment of the frame, each profile band having a lumbar portion adapted to bulge forwardly at the level of the lumbar region: the pelvic cradle being connected to the profile band to apply a variable compressive force to at least a portion of the profile band along its elongate direction whereby the degree of bulge of the lumbar region of each profile band is controllable in response to the position of the thigh support.

7. The seating mechanism as defined in claim 1 further comprising a seat back rigidly connected to and extending upwardly from the pelvic cradle, the cradle and seat back being movable as a unit.

8. A seating mechanism comprising:

a frame having forward and rearward portions;

a pair of substantially parallel links, each pivotally mounted at first and second pivot axes to the forward portion of the frame and extending rearwardly and upwardly;

a seating member disposed above the frame for supporting the pelvic region of a user, the upper ends of the parallel links each being pivotally connected at third and fourth pivot axes to the rearward portion of the seating member whereby pivoting the parallel links about their first and second pivots moves the seating member upwardly and forwardly while maintaining a constant attitude for the seating member;

a thigh support having forward and rearward portions, the rearward portion being pivotally connected to the seating member at the fourth pivot axis and extending forwardly of the seating member;

a guide link pivotally mounted to the rearward portion of the frame and extending upwardly and forwardly, the guide link being pivotally connected to the forward end of the thigh support;

the parallel and guide links and their respective pivots being arranged to enable downward force to be applied by the user's thighs to the thigh support to cause the thigh support to tilt forwardly while maintaining the seating member in a constant attitude thereby increasing the seating angle while enabling the user's spine and pelvis to remain in vertical alignment.

9. The seating mechanism as defined in claim 8 further comprising a seat back secured to and extending upwardly from the seating member.

10. The seating mechanism as defined in claim 9 wherein the seating member and seat back are integrally formed as a unitary structure.

11. The seating mechanism as defined in claim 8 wherein the seat member has leg cut-outs at its sides.

12. The seating mechanism as defined in claim 8 further comprising a pneumatic gas lift supporting the frame.

13. The seating mechanism as defined in claim 12 further comprising a base supporting the pneumatic gas lift.

* * * * *